US010309747B2

(12) United States Patent
Samson et al.

(10) Patent No.: US 10,309,747 B2
(45) Date of Patent: Jun. 4, 2019

(54) FIREARM RAIL/HANDGUARD AND MOUNTING SYSTEM

(71) Applicant: Samson Manufacturing Corp., Keene, NH (US)

(72) Inventors: Scott Samson, Spofford, NH (US); Tanner Landis, Keene, NH (US); Andrew Dreher, Spofford, NH (US)

(73) Assignee: Samson Manufacturing Corporation, Keene, NH (US)

( * ) Notice: Subject to any disclaimer, the term of this patent is extended or adjusted under 35 U.S.C. 154(b) by 0 days.

(21) Appl. No.: 15/873,299

(22) Filed: Jan. 17, 2018

(65) Prior Publication Data

US 2018/0202757 A1 Jul. 19, 2018

Related U.S. Application Data

(60) Provisional application No. 62/447,183, filed on Jan. 17, 2017.

(51) Int. Cl.

| | |
|---|---|
| ***F41C 23/00*** | (2006.01) |
| ***F41C 23/16*** | (2006.01) |
| ***F41A 21/48*** | (2006.01) |
| ***F41A 3/66*** | (2006.01) |

(52) U.S. Cl.

CPC ..... *F41C 23/16* (2013.01); *F41A 3/66* (2013.01); *F41A 21/48* (2013.01)

(58) Field of Classification Search

CPC ..... F41C 23/16

See application file for complete search history.

(56) References Cited

U.S. PATENT DOCUMENTS

| | | | | |
|---|---|---|---|---|
| 7,770,317 | B1 * | 8/2010 | Tankersley | F41C 23/16 42/71.01 |
| 8,904,691 | B1 | 12/2014 | Kincel | |
| 9,335,117 | B2 | 5/2016 | Miller | |
| 9,389,043 | B1 * | 7/2016 | Zhang | F41C 23/16 |
| 9,464,865 | B2 * | 10/2016 | Shea | F41C 23/16 |
| 9,791,239 | B1 * | 10/2017 | Kincel | F41C 23/16 |
| 2011/0000119 | A1 * | 1/2011 | Desomma | F41A 3/66 42/75.02 |
| 2011/0126443 | A1 * | 6/2011 | Sirois | F41C 23/16 42/90 |
| 2011/0239513 | A1 * | 10/2011 | Sandman | F41C 23/16 42/90 |
| 2012/0186123 | A1 * | 7/2012 | Troy | F41C 23/16 42/71.01 |
| 2012/0246989 | A1 * | 10/2012 | Troy | F41C 23/16 42/71.01 |

(Continued)

*Primary Examiner* — Gabriel J. Klein

(74) *Attorney, Agent, or Firm* — Burns & Levinson LLP; Bruce D. Jobse

(57) ABSTRACT

An assembly for mounting a handguard to a firearm prevents longitudinal, axial, or radial misalignment relative to the axis of the firearm barrel by utilizing a biasing element disposed intermediate the barrel nut and the interior diameter of the handguard, a clamping element positioned opposite the biasing element about the perimeter of the barrel nut and having a first wedged surface, and a threaded wedge configured to co-act with the first wedged surface of the clamping element to directionally force the clamping element against the barrel nut in a manner that prevents canting of the handguard.

16 Claims, 5 Drawing Sheets

(56) References Cited

U.S. PATENT DOCUMENTS

| | | | | |
|---|---|---|---|---|
| 2017/0097207 | A1* | 4/2017 | Hines | F41C 23/16 |
| 2017/0160048 | A1* | 6/2017 | Galletta, II | F41C 23/16 |
| 2018/0306551 | A1* | 10/2018 | Reid | F41C 23/16 |

* cited by examiner

FIREARM RAIL/HANDGUARD AND MOUNTING SYSTEM

FIELD OF THE INVENTION

The disclosure relates to the field of firearm accessories and, more specifically, to an assembly for mounting a modular rail/handguard assembly to a firearm which maintains proper alignment of the assembly with the firearm barrel.

BACKGROUND OF THE INVENTION

In the general field of combat and commercial weaponry, there is a broad range of accessories available for mounting onto standard firearms in order to upgrade the capability of these weapons. Of particular interest in the context of upgrade accessories is the M16/M4 weapon system that is typically utilized in military or combat settings. Most new models of the M16/M4 weapons also include a dovetail rail interface integrally formed along the top of the upper receiver. This interface rail provides a convenient mounting point for many of the available accessories for use with the M16/M4 firearm, such as scopes, sighting devices, lasers, and directed fire devices. The barrel is held in assembled relation with the upper receiver by a barrel nut that is threaded onto the outside surface of the barrel-receiving receptacle.

Some commercially available after market arm rail/handguard assembly systems require permanent modification of the firearm, such as replacing the original barrel nut with a proprietary barrel nut design, before installation thereof, while others are compatible with the existing configuration of the barrel nut provided by the manufacturer. Either way, it is critical during the installation and use of the rail/handguard assembly that the alignment of the rail/handguard assembly longitudinally, axially, and radially relative to the axis of the barrel bore be free from slippage, canting, or other angular displacements, less accessories, such as scopes securable to the rail/handguard assembly not provide true aiming of the firearm.

It would therefore be useful to provide a modular rail assembly for use with a firearm that prevents any of longitudinal, axial, or radial misalignment of the modular rail assembly relative to the barrel of the firearm at the time of installation.

It would be further useful to provide a modular rail assembly for use with a firearm which prevents any of longitudinal, axial, or radial misalignment of the modular rail assembly relative to the barrel axis of the firearm during use.

BRIEF SUMMARY OF THE INVENTION

Disclosed is an assembly for mounting a modular rail to a firearm which maintains proper alignment of the modular rail assembly with the firearm barrel. In particular, the disclosure is directed to an improved mounting configuration for attaching the modular rail assembly to the barrel nut of a firearm that prevents any of longitudinal, axial, or radial misalignment of the modular rail assembly relative to the barrel of the firearm during use. The assembly utilizes a biasing element disposed intermediate the barrel nut and the interior diameter of the handguard, a clamping element positioned opposite the biasing element about the perimeter of the barrel nut and having a first wedged surface, and a threaded wedge configured to co-act with the first wedged surface of the clamping element to directionally force the clamping element against the barrel nut in a manner that prevents canting of the handguard.

According to one aspect of the disclosure, an assembly apparatus for securing a handguard to a firearm having a cylindrical barrel nut, the assembly system comprises: a handguard having a first end with an interior diameter shaped to receive at least a portion of an exterior of the barrel nut thereagainst; a biasing element disposable intermediate the barrel nut and the interior diameter of the handguard, the biasing element having first and second biasing surfaces disposable adjacent first and second exterior surface portions, respectively, of the barrel nut; a mechanism for securing the biasing element intermediate the handguard and the barrel nut, a clamping element having a first wedged surface and disposable intermediate the barrel nut and the interior diameter of the handguard opposite the biasing element about the barrel nut exterior; and a threaded wedge having a second wedged surface configured to co-act with the first wedged surface of the clamping element to force the clamping element against the barrel nut. In embodiments, the biasing element prevents movement of the handguard longitudinally along the axis of the barrel. In another embodiment, one or both of the biasing element and clamping element have arcuate surfaces disposed adjacent the exterior perimeter of the barrel nut to prevent radial and/or rotational movement of the barrel nut within the interior of the handguard end. In embodiments, the threaded wedge further comprises a threaded aperture extending therethrough for receiving a threaded fastener and the clamping element further comprises a pair of surfaces adjacent the first wedged surface for retaining the threaded wedge in alignment with the clamping element as the second wedged surface of the threaded wedge slides against the first wedged surface of the clamping element while being driven by rotation of the threaded fastener.

According to another aspect of the disclosure, an assembly kit for use with a firearm having a barrel nut and a handguard comprises: a biasing element disposable intermediate the barrel nut and an interior diameter of the handguard, the biasing element having first and second biasing surfaces disposed adjacent first and second exterior surface portions, respectively, of the barrel nut; a mechanism for securing the biasing element intermediate the handguard and the barrel nut, a clamping element having a first wedged surface, the clamping element disposable intermediate the barrel nut and the interior diameter of the handguard opposite the biasing element about one of the first and second exterior surface portions of the barrel nut; and a threaded wedge having a second wedged surface configured to co-act with the first wedged surface of the clamping element to directionally force the clamping element against the barrel nut. In embodiments, one or both of the biasing element and clamping element have arcuate surfaces disposed adjacent the exterior perimeter of the barrel nut and prevent radial and/or rotational movement of the barrel nut within the interior of the handguard end. In embodiments, the threaded wedge further comprises a threaded aperture extending therethrough for receiving a threaded fastener and the clamping element further comprises a pair of surfaces adjacent the first wedged surface for retaining the threaded wedge in alignment with the clamping element as the second wedged surface of the threaded wedge slides against the first wedged surface of the clamping element while being driven by rotation of the threaded fastener.

According to yet another aspect of the disclosure, a method for mounting a handguard to a firearm having a cylindrical barrel nut, the method comprises: A) disposing a first end of the handguard about a portion of the barrel nut; B) inserting a biasing element intermediate the first end of the handguard and the barrel nut at a first location about an exterior perimeter of the barrel nut; C) inserting a clamping element intermediate the first end of the handguard and the barrel nut at a second location opposite the first location about the exterior perimeter of the barrel nut, the clamping element having a first wedged surface; and D) urging the clamping element against the barrel nut with a movable wedge having a second wedged surface configured to co-act with the first wedged surface of the clamping element. In one embodiment, the threaded wedge further comprises a threaded aperture having a threaded fastener extending at least partially therethrough and journaled with the handguard and wherein D) comprises: D1) rotating the threaded fastener to force the second wedged surface of the threaded wedge to slide along the first wedged surface of the clamping element.

For a better understanding of the disclosed system and apparatus, its operating advantages, and the specific objects attained by its uses, reference should be had to the accompanying drawings and descriptive matter in which there are illustrated embodiments.

DETAILED DESCRIPTION OF THE INVENTION

Figure 1:
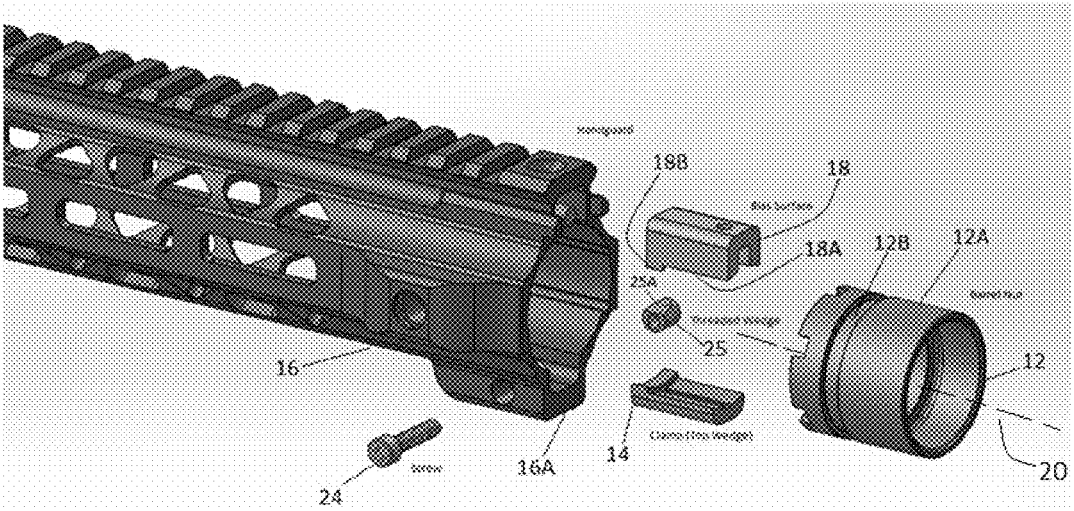
FIG. 1 is a side, perspective view of an embodiment of the mounting assembly system in accordance with the disclosure.

FIGS. 1-5 illustrate embodiments of the modular assembly 10 for mounting a rail/handguard in accordance with the disclosure. The mounting assembly 10 comprises a handguard 16, optional barrel nut 12, and mounting system 15. Handguard 16 is the structural element that supports the entire assembly and serves to transfer the loads or additional weight induced by any attachments into the upper receiver of the firearm. Mounting system 15 comprises a clamping element 14, biasing element 18, and threaded wedge 25, which are mechanically coupled intermediate barrel nut 12 and handguard 16, as well as their respective attachment mechanisms, as described herein in greater detail.

As illustrated in the Figures, a cylindrical barrel nut 12 extends longitudinally along an axis 20 and has an exterior perimeter defining first and second exterior surface portions 12A and 12B with different exterior diameter values relative to the axis. In the illustrative embodiment, the transition between the diameters of portions 12A and 12B is abrupt, causing a step down in the diameter exterior perimeter. In embodiments, barrel nut 12 may have other exterior perimeter surface features as may be designed by the manufacturer of the firearm. Handguard 16 has a first end 16A with an interior diameter 16B shaped to receive at least a portion of one of the first and second exterior barrel nut portions 12A and 12B thereagainst.

Biasing element 18 is disposed intermediate the barrel nut 12 and the interior diameter 16B of the handguard 16 and has first and second biasing surfaces 18A and 18B disposed adjacent the first and second exterior surface portions 12A and 12B, respectively, of the barrel nut 12. In embodiments, the surfaces of biasing element 18 disposed adjacent the exterior perimeter of barrel nut 12, including one or both of first and second biasing surfaces 18A and 18B, may be arcuate in shape with substantially the same degree of curvature as exterior perimeter portion of barrel nut 12 against which the second biasing surfaces 18A and 18B are disposed. In the illustrative embodiment, biasing element 18 may have a generally L-shaped length profile, as seen parallel to axis 20, and may have along a portion of its length a generally U-shaped cross-sectional profile, as seen from a plane normal to axis 20. Biasing element 18 is disposed opposite clamping element 14 about the interior of inner diameter 16B of handguard 16. Biasing element 18 is seated in an indentation in the interior surface of inner diameter 16B, as illustrated. A pair of axially aligned apertures extending at least partially through both biasing element 18 and handguard 16 may accept a screw 22 or other fastening mechanisms, threaded or not, for securing the biasing element 18 intermediate the handguard 16 and the barrel nut 12, as illustrated in the Figures.

Figure 3:
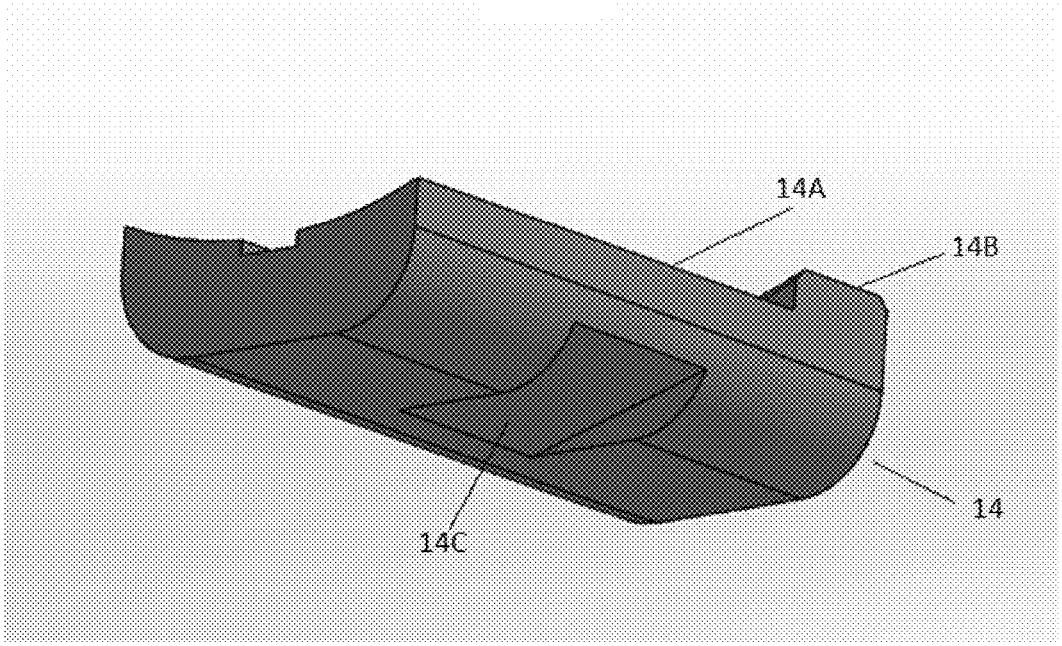
FIG. 3 is a bottom, perspective view of the wedged clamping element of the mounting assembly system in accordance with the disclosure.

Clamping element 14 is disposed opposite biasing element 18 about the interior of inner diameter 16B of handguard 16 and is seated in an indentation in the interior surface of inner diameter 16B. As illustrated in FIG. 3, clamping element 14 comprises first and second clamping surfaces 14A and 14B, which may be arcuate in shape with substantially the same degree of curvature as barrel nut exterior perimeter portions 12A and 12B against which they are disposed, respectively. In the illustrative embodiment, clamping element 14 may also have a generally L-shaped length profile, as seen parallel to axis 20, and may have along a portion of its length a solid cross-sectional profile, as seen from a plane normal to axis 20. Clamping element 14 further comprises a wedge surface 14C formed in the bottom surface thereof facing toward screw 24. A threaded aperture extends at least partially through handguard 16 and receives screw 24, as illustrated in the Figures.

Figure 2:
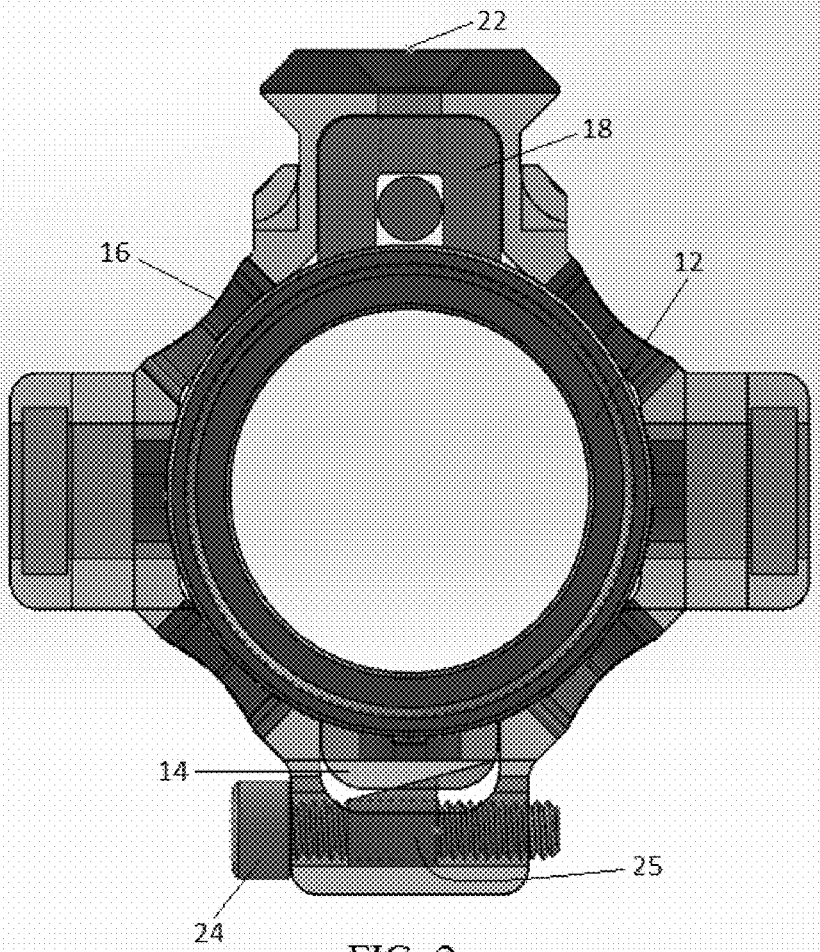
FIG. 2 is a front, end-on view of an embodiment of the mounting assembly system in accordance with the disclosure.
Figure 4:
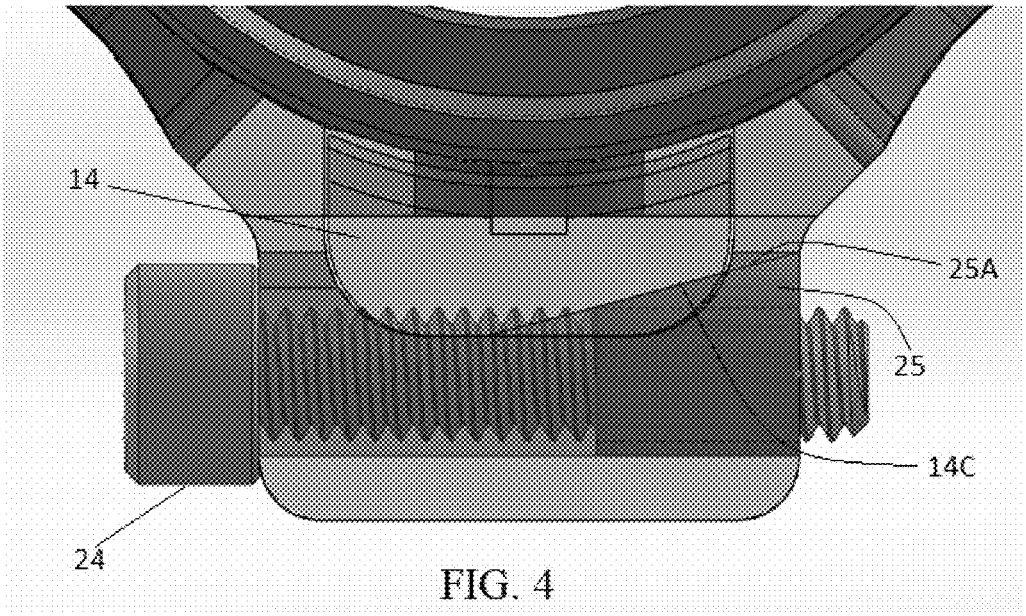
FIG. 4 is a partial, cutaway view of a wedged clamping element and threaded wedge of the mounting assembly system in a released, unclamped configuration in accordance with the disclosure.
Figure 5:
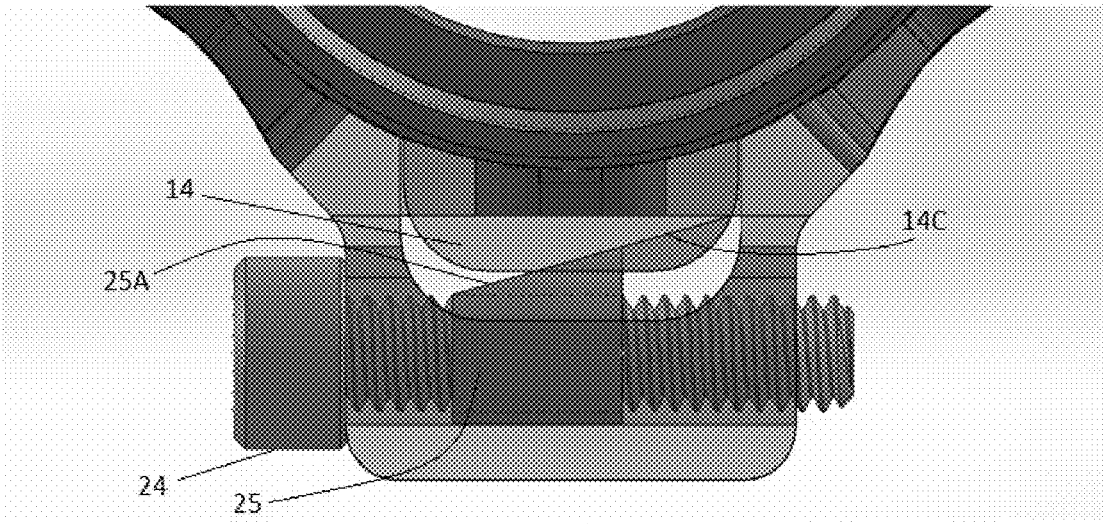
FIG. 5 is a partial, cutaway view of a wedged clamping element and threaded wedge of the mounting assembly system in a tightened, clamped configuration in accordance with the disclosure.

Mounting system 15 further comprises a threaded wedge 25 having a wedged top surface 25A which compliments wedge surface 14C of clamping element 14. A threaded aperture extends at least partially through threaded wedge 25 and also receives screw 24, as illustrated in the Figures. When the screw 24 is tightened, threaded wedge 25 travels horizontally along the axis of screw 24, causing wedged top surface 25A to slide under wedge shaped surface 14C of clamping element 14, forcing clamping element 14 upward and causing one or both of clamping surfaces 14A and 14B to engage the exterior perimeter surface of barrel nut 12, as illustrated in FIGS. 4-5. As clamping element 14 puts upward force on barrel nut 12, the biasing element 18 prevents handguard 16 from canting. In embodiments, clamping element 14 and threaded wedge 25 having complimentary mating features, such as one of a tongue and groove at their respective edges thereof, to facilitate alignment of wedge surface 14C against wedged top surface 25A, as threaded wedge 25 travels horizontally along the axis of screw 24. In embodiments, the clamping element 14 further comprises a pair of surfaces 14D adjacent the wedged surface 14C for retaining the threaded wedge 25 in alignment with clamping element 14 as wedged surface 14C wedge slides against the wedged top surface 25A of the clamping element 25 as threaded wedge 25 travels horizontally along the axis of screw 24. In FIGS. 2, and 4-5, the clamping element 14 is shown in partial cross section as seen along line 3-3 of FIG. 3 to illustrate the relationship between wedged surface 14C and wedged top surface 25A.

In practice, the method for mounting a handguard 16 to a firearm having a cylindrical barrel nut 12 comprises first exposing the barrel nut 12 and then disposing a first end of the handguard about a portion of the barrel nut followed by inserting a biasing element intermediate the first end of the handguard and the barrel nut at a first location about an exterior perimeter of the barrel nut and inserting a clamping element intermediate the first end of the handguard and the barrel nut at a second location opposite the first location about the exterior perimeter of the barrel nut, the clamping element having a first wedged surface. Thereafter, the clamping element is urged or secured against the barrel nut with a movable wedge having a second wedged surface configured to co-act with the first wedged surface of the clamping element. Because the threaded wedge comprises a threaded aperture having a threaded fastener extending at least partially therethrough and journaled with the handguard, rotating the threaded fastener will force the second wedged surface of the threaded wedge to slide along the first wedged surface of the clamping element.

Because both biasing element 18 and clamping element 14 mimic the abrupt transition between the diameters of barrel nut 12 between surfaces 12A and 12B, the longitudinal cross-sectional profiles of both biasing element 18 and clamping element 14 along axis 20 are generally L-shaped and prevent of longitudinal misalignment of the handguard assembly relative to axis 20 of barrel nut 12 at the time of installation and during use. Similarly, because biasing surfaces 18A and 18B of biasing element 18 and clamping surfaces 14A and 14B of clamping element 14 have arcuate surfaces that mimic the respective curvatures of surfaces 12A and 12B of barrel nut 12 with which contact is made, axial and/or radial misalignment of the handguard 16 relative to barrel nut 12 is prevented at the time of installation and during use.

Handguard 16 may be formed generally as a tubular enclosure that is configured to encircle the barrel of the firearm when assembly 10 is installed on the firearm in a mounted position. In the illustrative embodiments, handguard 16 has a unitary or monolithic construction defined by left and right side walls that extend between ends thereof and generally outwardly and downwardly in an arcuate manner from an integrally formed top dovetail rail to form a substantially cylindrical body. Top dovetail rail extends at least partially longitudinally between the forward end and the rearward end. An optional supplemental dovetail rail interface may be slidably attached to the bottom of handguard 16 utilizing an integrally formed projection having a complimentary mating cross-sectional profile.

In the embodiments, any elements of assembly 10 and mounting system 15 may be formed of substantially rigid materials including steel, stainless steel, aluminum, ceramics, or other materials capable of withstanding heat generated by the barrel nut 12 during use of the firearm.

As illustrated in the Figures, side walls of the handguard 16 may have a plurality of wall vents extending therethrough to facilitate cooling of the firearm barrel by allowing heated air from the interior of handguard 16 to escape through the vents. It will be obvious to those reasonably skilled in the art that any configuration or shape of sidewall vents, including an open lattice structure, may partially define one or both of sidewalls. It will be further obvious to those reasonably skilled in the art that handguard 16 may have other cross-sectional profiles, such as a pentagon or octagon or other configuration. In addition, although handguard 16 in the illustrative embodiment forms an integral sleeve-like structure, it is contemplated herein that one or more constituent components thereof may be separately assembled into a sleeve-like structure which is insertable over the open end of barrel.

While the fasteners illustrated with regard to the illustrative embodiments, including screws 22, have been shown to be conventional threaded screws, other fastening mechanisms may be equivalently substituted. For example, screws 22 may be replaced with a combination of helicoil inserts and threaded fastening mechanisms. Such helicoil inserts may have threaded exteriors for coupling with threaded interiors of apertures which extend through the handguard 16. The helicoil inserts may also have a threaded interior which can couple with the threaded exterior of screw 22 or other fastening mechanisms. In some cases, such helicoil inserts may be formed from a stronger and more rigid material than the handguard 16 (i.e. steel versus aluminum) to prevent the handguard 16 from warping, crushing, or otherwise deforming due to force through the fastening mechanisms. In embodiments, the lower surfaces of the fastening mechanisms and the surfaces with which they have contact may be flat to maximize contact area.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An assembly apparatus for securing a handguard to a firearm having a cylindrical barrel nut, the assembly apparatus comprises:

a handguard having a first end with an interior diameter shaped to receive at least a portion of an exterior of the barrel nut thereagainst;

a biasing element disposable intermediate the barrel nut and the interior diameter of the handguard, the biasing element having first and second biasing surfaces disposable adjacent first and second exterior surface portions, respectively, of the barrel nut;

a mechanism for securing the biasing element intermediate the handguard and the barrel nut, a clamping element having a first wedged surface and disposable intermediate the barrel nut and the interior diameter of the handguard opposite the biasing element about the barrel nut exterior; and a threaded wedge having a second wedged surface configured to co-act with the first wedged surface of the clamping element to force the clamping element against the barrel nut.

2. The apparatus of claim 1 in combination with a cylindrical barrel nut extending along an axis and having an exterior perimeter defining first and second exterior surface portions with different exterior diameter values relative to the axis.

3. The apparatus of claim 1 wherein the biasing element prevents movement of the handguard longitudinally along the axis of the barrel.

4. The apparatus of claim 1 wherein the biasing element has an arcuate surface disposable adjacent the exterior perimeter of the barrel nut to prevent at least one of radial and rotational movement of the handguard first end relative the barrel nut.

5. The apparatus of claim 1 wherein the clamping element has an arcuate surface disposable adjacent the exterior perimeter of the barrel nut to prevent at least one of radial and rotational movement of the handguard first end relative the barrel nut.

6. The apparatus of claim 1 wherein the clamping element further comprises a pair of surfaces adjacent the first wedged surface for retaining a threaded fastener in alignment with the clamping element as the second wedged surface slides against the first wedged surface.

7. The apparatus of claim 1 wherein the threaded wedge further comprises a threaded aperture extending therethrough for receiving a threaded fastener.

8. The apparatus of claim 1 in combination with a threaded fastener extending at least partially through the threaded wedge.

9. An assembly kit for use with a firearm having a barrel nut and a handguard, the kit comprising:

a biasing element disposable intermediate the barrel nut and an interior diameter of the handguard, the biasing element having first and second biasing surfaces disposed adjacent first and second exterior surface portions, respectively, of the barrel nut;

a mechanism for securing the biasing element intermediate the handguard and the barrel nut, a clamping element having a first wedged surface, the clamping element disposable intermediate the barrel nut and the interior diameter of the handguard opposite the biasing element about one of the first and second exterior surface portions of the barrel nut; and a threaded wedge having a second wedged surface configured to co-act with the first wedged surface of the clamping element to directionally force the clamping element against the barrel nut.

10. The assembly kit of claim 9 wherein biasing element has an arcuate surface for positioning adjacent the exterior perimeter of the barrel nut to prevent at least one of radial and rotational movement of the handguard first end relative the barrel nut.

11. The assembly kit of claim 9 wherein the clamping element has an arcuate surface disposable adjacent the exterior perimeter of the barrel nut to prevent at least one of radial and rotational movement of the handguard first end relative the barrel nut.

12. The assembly kit of claim 9 wherein the clamping element further comprises a pair of surfaces adjacent the first wedged surface for retaining a threaded fastener in alignment with the clamping element as the second wedged surface slides against the first wedged surface.

13. The assembly kit of claim 9 wherein the threaded wedge further comprises a threaded aperture extending therethrough for receiving a threaded fastener.

14. The assembly kit of claim 9 in combination with a cylindrical barrel nut extending along an axis and having an exterior perimeter defining first and second exterior surface portions with different exterior diameter values relative to the axis.

15. The assembly kit of claim 9 in combination with a handguard having a first end with an interior diameter shaped to receive at least a portion of a barrel nut exterior thereagainst.

16. The assembly kit of claim 9 in combination with a threaded fastener extending at least partially through the threaded wedge.

* * * * *